US006644650B2

(12) United States Patent
Fang et al.

(10) Patent No.: US 6,644,650 B2
(45) Date of Patent: Nov. 11, 2003

(54) AUTOMATIC DOCUMENT FEEDING APPARATUS

(75) Inventors: Po-Hua Fang, Taipei (TW); Shu-Ya Chiang, TaiChung (TW)

(73) Assignee: Umax Data Systems, Inc. (TW)

( * ) Notice: Subject to any disclaimer, the term of this patent is extended or adjusted under 35 U.S.C. 154(b) by 0 days.

(21) Appl. No.: 09/944,812

(22) Filed: Aug. 31, 2001

(65) Prior Publication Data

US 2003/0042667 A1 Mar. 6, 2003

(51) Int. Cl.[7] ..... B65H 3/52
(52) U.S. Cl. ..... 271/167
(58) Field of Search ..... 271/121, 114, 271/167, 37; 400/693

(56) References Cited

U.S. PATENT DOCUMENTS 5,186,557 A * 2/1993 Fushimi ..... 400/691
5,653,433 A * 8/1997 Ishizuka ..... 271/121
5,727,782 A * 3/1998 Okada ..... 271/121

* cited by examiner

*Primary Examiner*—Donald P. Walsh
*Assistant Examiner*—Kenneth W Bower

(57) ABSTRACT

An automatic document feeding apparatus comprises a paper case, a dividing unit, and a paging document-feeding device. The paper case has an open space, for containing a plurality of papers. The dividing unit is disposed at proper location inbeing the open space, for dividing said plurality of papers into paper of a first zone and those of a second zone. The paging document-feeding device is connected with the paper case for feeding a single paper from papers of the first zone.

9 Claims, 3 Drawing Sheets

AUTOMATIC DOCUMENT FEEDING APPARATUS

FIELD OF THE INVENTION

The present invention relates to an automatic document feeding apparatus, especially to the improved automatic document feeding apparatus of a paper case that can install large amount of pre-placed papers.

BACKGROUND OF THE INVENTION

Coming after the times of continuous improvement, today's electronic products such as scanner, facsimile, photocopier, and printer etc. are born to world to provide the needed convenience in life. And when above-mentioned electronic products are in application, since only one piece of paper can be placed at one time to accomplish the needing motion requirement, so it wastes a redundant time. Therefore, since the automatic document feeding apparatus has been developed, so it provides single paper paging and feeding to greatly improve the application inconvenience of above-mentioned electronic products.

Please refer to FIG. 1, which shows an embodiment illustration for an automatic document feeding apparatus of prior art applied in a scanning apparatus. Wherein, the automatic document feeding apparatus is connected with a scanning apparatus 40 to provide a placement of plural pieces of paper 50 and a scanning motion of paging and document feeding for the single paper 50.

Please refer to FIG. 2, which shows a structural section-viewing illustration for an embodiment of prior automatic document feeding apparatus. The prior automatic document feeding apparatus is arranged with a paper case 10. The paper case 10 is a hollow shell with an open space. The open space may provide a placement for plural pieces of paper 50. The prior automatic document feeding apparatus also is arranged with a paging document feeding device 30 that is connected to the paper case 10 and provides the document feeder function for the plural pieces of paper 50.

Wherein the paging document feeding device 30 is a structure that provides the functions of paging and paper feeding and brings in plural papers 50 by a friction force of a roller 31. Since the friction forces have different sizes of designs of different machine types, so the brought in papers 50 may be one piece, two pieces, or more. The brought in one piece, two pieces or more pieces of papers 50 are positioned between a paper-dividing piece 32 and the roller 31, by pressing one end of the paper-dividing piece 32 against the roller 31. The paper-dividing piece 32 is connected to an elastic element 33, being a spring and can provide elastic force to make the paper-dividing piece 32 presses against the roller 31.

Since the design is that the friction coefficient between the material of roller 31 and the paper 50 is greater than the friction coefficient between the material of paper-dividing piece 32 and the paper 50, and the friction coefficient between the material of paper-dividing piece 32 and paper 50 is greater than the friction coefficient among the papers 50, so when the roller 31 brings in one piece, two pieces or more pieces of papers, because the friction coefficients among the roller 31, paper-dividing piece 32 and papers 50 are different, it will cause that only single piece of paper 50 be rolled out from the roller 31 to complete the functions of document feeding and paging.

When the prior automatic document feeding apparatus places plenty of pre-placed papers 50, firstly because the gravity of the large amount of papers 50 impacts the roller 31, it causes the friction coefficient of the roller 31 to change. The influence of the change of friction force will be unable to reach the expecting usage. Or because the direct impact of the incoming of large amount of papers 50, the elastic element 33 will be over-pressed and the function of paging document feeding device 30 will be useless and the function of paging can not be reached.

In summarizing above descriptions, it can be concluded that the prior automatic document feeding apparatus usually will send out several pieces of paper when the prior automatic document feeding apparatus is over-loaded with large amount of pre-placed paper, and the amount of pre-placed papers must be replaced or reduced by the observing operation personnel, so lots of man power, time and materials are wasted. Above problem must be solved as soon as possible no matter in individual or in industry to reduce the cost paid by individual or society and to promote the nation's industry competition power. Therefore the breakthrough of this problem is most urgent indeed.

SUMMARY OF THE INVENTION

The major object of the present invention is to provide an improved automatic document feeding apparatus, which can supply large amount of pre-placed paper and ensure the functions of automatic paper feeding and paging.

In order to reach above-mentioned object, an improved automatic document feeding apparatus of the present invention includes a paper case, a dividing unit and a paging document-feeding device.

The paper case is has an open space for containing a plurality of papers.

The dividing unit is disposed at proper location inbeing the open space, for dividing said plurality offer providing papers into paper of a first zone and those of a second zone.

The paging document feeding device is connected to the paper case, for feeding a single paper from papers of the first zone.

For your esteemed reviewing committee members to further understand and recognize the present invention, a detailed description in accordance with several drawings are presented as following.

DETAILED DESCRIPTION OF THE PREFERRED EMBODIMENT

The major characteristic of the improved automatic document feeding apparatus of the present invention is that a dividing unit is arranged in the paper case. The dividing unit may provide large amount of pre-placed paper and avoid the direct impact or over-pressing on the paging document feeding device to reach the function, which automatic paper feeding apparatus may place large amount of pre-place papers but without the influence on paging.

Figure 1:
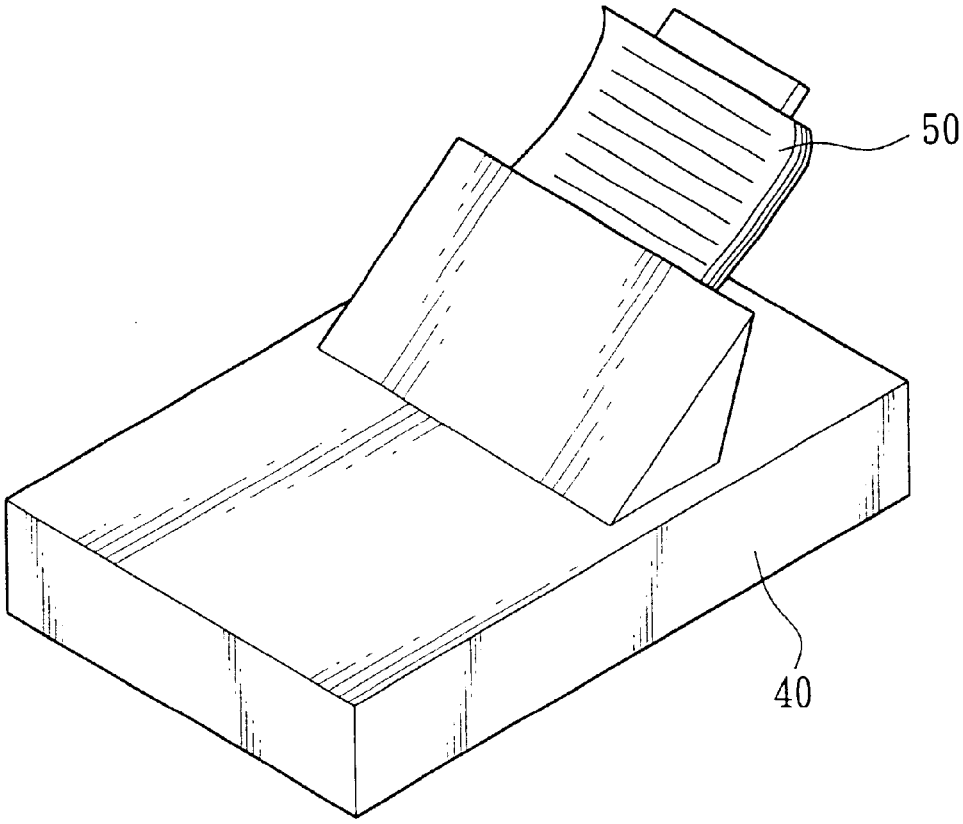
FIG. 1 (PRIOR ART)
FIG. 1 is an implement illustration for the prior automatic document feeding apparatus in scanning apparatus.
Figure 2:
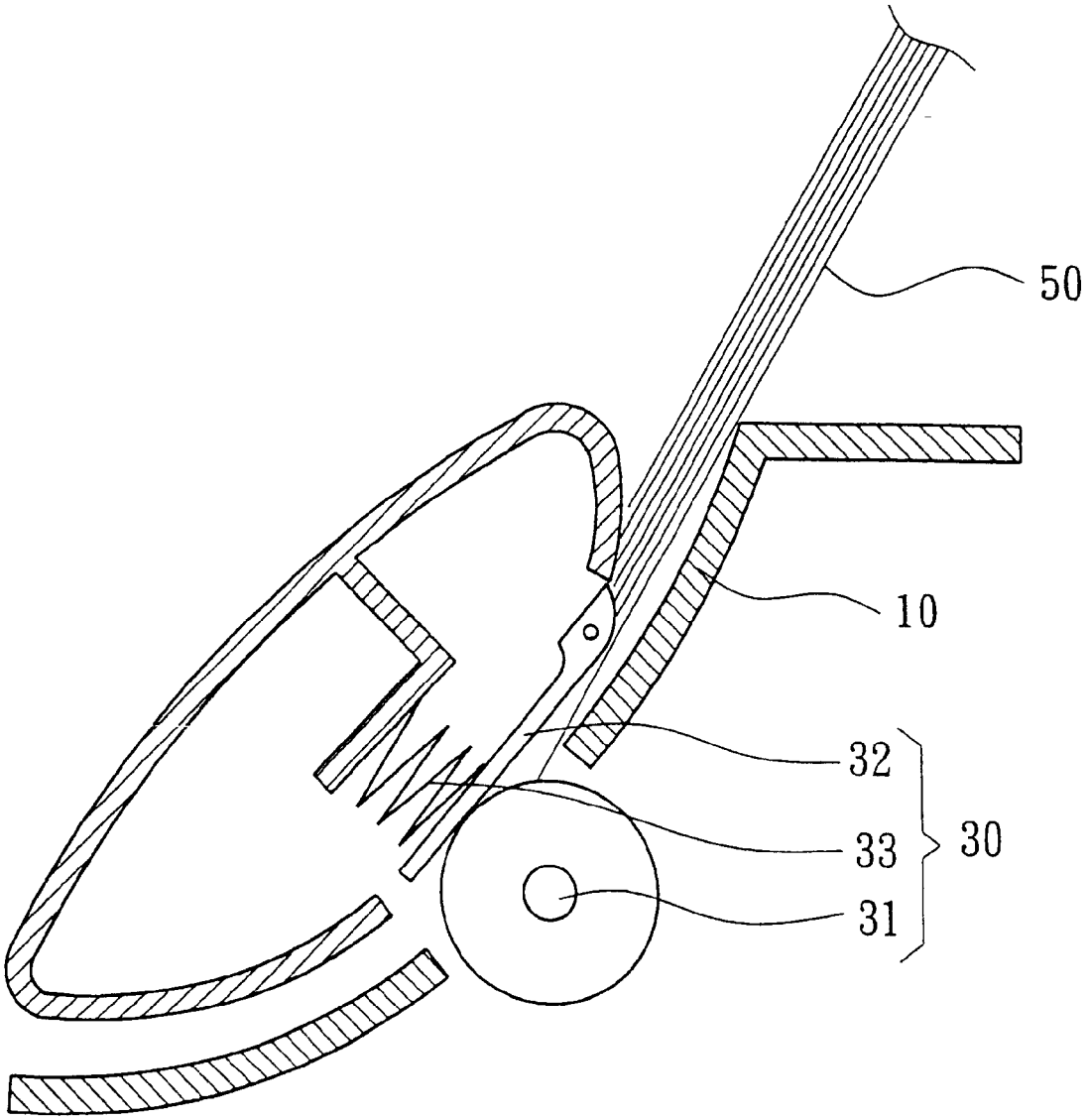
FIG. 2 (PRIOR ART)
FIG. 2 is a sectional illustration for the implement apparatus structure of the prior automatic document feeding apparatus.
Figure 3:
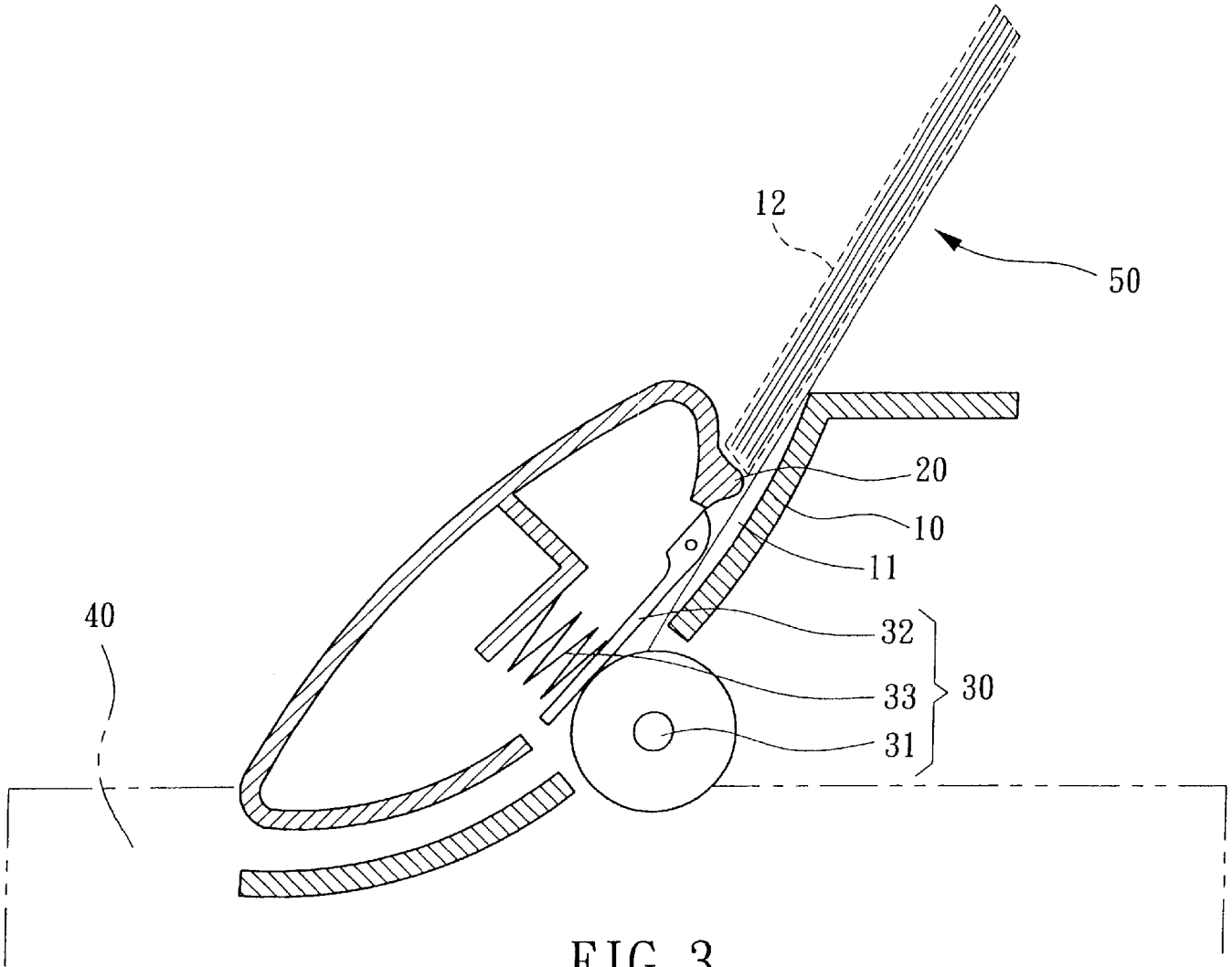
FIG. 3 is a sectional illustration for the apparatus structure of the preferable embodiment of the improved automatic document feeding apparatus of the present invention.

Please refer to FIG. 3, which shows the sectional illustration for the apparatus structure of the preferable embodiment of the improved automatic document feeding apparatus of the present invention. The improved automatic document feeding apparatus of the present invention includes a paper case 10, a dividing unit 20 and a paging document feeding device 30.

The paper case 10 is a hollow shell having an open space for containing a plurality of papers. In the preferable embodiment of the present embodiment, the paper case 10 has an appropriate angle of paper feeding respective to the scanning apparatus 40. Of course, the angle of paper feeding can also be a horizontal or vertical device design. This sort of technique is an easy implementation for persons who are familiar with such technique of aforethought description of the present invention, so this sort of changes is really within the technical field of the present invention.

The dividing unit 20 is arranged at an appropriate position inside the open space. Wherein, the dividing unit 20 and the paper case 20 are formed to one body. Of course, the dividing unit 20 may also be a dividing element for the paper case 10, and its material may be plastic, silica gel, rubber, or other composite materials. The function of the dividing unit 20 is to separate the plural pieces of paper 50 into papers of a first zone 11 and papers of a second zone 12.

The paging document feeding device 30 is connected with the paper case 10 and feeding papers of the first zone 11 to proceed a document feeding process for single paper 50. Wherein the paging document feeding device 30 further includes a roller, which bring in the first zone paper 11 by a friction force, and place the brought in first zone paper 11 between the paper-dividing piece 32 and the roller 31. The device also includes an elastic element 33, being connected to the paper-dividing piece 32. The elastic element 33 is a spring, which may provide an elastic force for pressing the paper-dividing piece 32 onto the roller 31. In a preferable embodiment of the present invention, the other end of the paper-dividing piece 32 is capable of connecting to the dividing element 20. This sort of structure change that may reach similar function is really within the technique field of the present invention, and additional description is no more needed in here.

When the present invention installs large amount of pre-placed papers, the second zone paper 12 would not directly impact the paging document feeding device 30, by using the dividing unit 20. While the first zone paper 11 is brought along with the second zone paper 12, so relatively the first zone paper 11 has no great impact acting on the roller 31. And after the using out of the first zone paper 11, the second zone paper will slide down slowly by the nature of gravity force and reach the function of automatic paper feeding. This sort of design will prevent the elastic element 33 from being over-pressed. Since the design is that the friction coefficient between the material of roller 31 and the paper 50 is greater than the friction coefficient between the material of paper-dividing piece 32 and the paper 50, and the friction coefficient between the material of paper-dividing piece 32 and paper 50 is greater than the friction coefficient among the papers 50, so because the friction coefficients among the roller 31, paper-dividing piece 32 and papers 50 are different, it will cause that only single piece of paper 50 be rolled out from the roller 31 to complete the function of paging.

From above improved automatic document feeding apparatus of present invention, the automatic document feeding apparatus can be indeed made to install large amount of pre-placed papers but still has no influence on the paging function. This arrangement may reduce the wastes of human power, time and materials and really overcome the technical shortcomings of prior art and satisfy the needs of industry and promote its competition force.

What is claimed is:

1. An automatic document feeding apparatus comprising:

A paper case that holds a plurality of documents in a first zone;

A second zone that leads from the output of the first zone to the input of a document feeding device;

A stationery dividing unit that restricts the flow of documents from the first zone to the second zone;

Wherein the documents are fed by gravity through the first and second zones;

a document-feeding device that is positioned in the second zone for feeding the one of the plurality of papers that has passed through the gap into the second zone.

2. The apparatus of claim 1, wherein the document-feeding device further includes:

a roller for feeding the one of the plurality of papers that has passed through the gap into the second zone;

a paper-dividing piece having a first end that presses against the roller such that the one of the plurality of papers is positioned between the first end of the paper dividing piece and the roller; and an elastic element that biases the paper-dividing piece against the roller.

3. The apparatus of claim 2, the paper-dividing piece has an opposing second end that is coupled to the dividing unit.

4. The apparatus of claim 2, wherein the friction coefficient between the material of the roller and the paper is greater than the friction coefficient between the material of the paper-dividing piece and the paper.

5. The apparatus of claim 2, wherein the friction coefficient between the material of the paper-dividing piece and the paper is greater than the friction coefficient among the plurality of papers.

6. The apparatus of claim 2, wherein the elastic element is a spring.

7. The apparatus of claim 1, wherein the dividing unit is formed in one piece with of the paper case.

8. The apparatus of claim 1, wherein the dividing unit is spaced-apart from the paper case.

9. The apparatus of claim 1, wherein the dividing unit is made of a material selected from the group consisting of plastic, silica gel and rubber.

* * * * *